United States Patent [19]

Higashiguchi et al.

[11] Patent Number: 5,060,023

[45] Date of Patent: Oct. 22, 1991

[54] DEVELOPING PROCESS FOR FORMING IMAGE HAVING HIGH QUALITY

[75] Inventors: Teruaki Higashiguchi, Tokyo; Takeshi Hori, Yokohama, both of Japan

[73] Assignee: Mita Industrial Co., Ltd., Osaka, Japan

[21] Appl. No.: 544,639

[22] Filed: Jun. 27, 1990

[30] Foreign Application Priority Data

Jun. 27, 1989 [JP] Japan ..... 1-162805

[51] Int. Cl.[5] ..... G03G 15/09

[52] U.S. Cl. ..... 355/251; 118/657; 118/658

[58] Field of Search ..... 118/657, 658; 355/251, 355/253

[56] References Cited

U.S. PATENT DOCUMENTS 4,576,465 3/1986 Fushida et al. ..... 118/658 X

FOREIGN PATENT DOCUMENTS 115132 8/1979 Japan ..... 118/658

103565 8/1980 Japan ..... 118/658

*Primary Examiner*—A. T. Grimley
*Assistant Examiner*—P. J. Stanzione
*Attorney, Agent, or Firm*—Sherman and Shalloway

[57] ABSTRACT

The present invention relates to a developing process for forming a high-quality image in the electrophotography. In this developing process, a two-component type developer is used and the moving direction of a developing sleeve is the same as the moving direction of a photosensitive material drum at the position of the sliding contact of the photosensitive material drum with a magnetic brush of the developer. In carrying out this forward direction sliding contact developing process, by setting the angle $\theta$ of a fixed main developing pole to the direction reverse to the moving direction of the sleeve from the line connecting the centers of the drum and sleeve and the drum/sleeve diameter ratio within certain specific ranges, the reproducibility of fine lines and the image density can be simultaneously improved very effectively in a well-balanced state, and a toner image having a high quality can be formed.

3 Claims, 2 Drawing Sheets

DEVELOPING PROCESS FOR FORMING IMAGE HAVING HIGH QUALITY

BACKGROUND OF THE INVENTION (1) Field of the Invention

The present invention relates to a developing process in the electrophotography. More particularly, the present invention relates to a developing process for forming a toner image having a high quality.

(2) Description of the Related Art

In the electrophotography using a two-component type magnetic developer, an electroscopic toner is mixed with a magnetic carrier, and this two-component composition is supplied to a developing sleeve having magnets disposed in the interior thereof to form a magnetic brush composed of this composition. An electrophotographic photosensitive plate having an electrostatic latent image is brought into contact with this magnetic brush to form an electroscopic toner image on the photosensitive plate. The electroscopic toner is charged with a polarity reverse to the polarity of the electrostatic latent image on the photosensitive plate by the friction with the magnetic carrier, and electroscopic toner particles on the magnetic brush are caused to adhere onto the electrostatic latent image by the Coulomb force to effect the development of the electrostatic latent image. On the other hand, the magnetic carrier is attracted by the magnets arranged in the sleeve, and the charged polarity of the magnetic carrier is the same as the polarity of the electrostatic latent image. Accordingly, the magnetic carrier is left on the sleeve.

Japanese Unexamined Patent Publication No. 59-172660 proposes a process in which a two-component type developer comprising a ferrite carrier and chargeable toner particles at a weight ratio of from 4/1 to 20/1 is used as the two-component type developer, a developing sleeve is moved in a direction opposite to the moving direction of a drum at the position of the sliding contact between the drum and the developer, and the development is carried out while fixing magnets in the sleeve under conditions satisfying the following requirements:

$$2.4 \geqq \left|\frac{v}{V}\right| \geqq 1.5,$$

$$\left|\frac{v}{V}\right| \geqq 0.12\,\theta + 1.8, \text{ and}$$

$$\theta \leqq 5$$

wherein $\theta$ represents the angle (degrees) of setting the magnetic pole closest to the line connecting the center of the drum and the center of the sleeve in the downstream direction of the rotation of the drum, V represents the peripheral speed of the drum, and $v$ represents the peripheral speed of the sleeve.

It is deemed that this conventional technique is significant in that by setting the peripheral speed of the drum, the peripheral speed of the sleeve and the angle of the main developing pole within certain ranges, a high-density image free of such defects as formation of brush marks, tailing of the carrier and formation of a blank portion by the edge effect can be obtained. In this process, however, problems arise because of the fact that the moving direction of the developing sleeve is reversed to the moving direction of the drum at the position of the sliding contact (this sliding contact will be called "reverse direction sliding contact" hereinafter, and the sliding contact in the state where both of the sleeve and drum are moved in the same direction will be called "forward direction sliding contact" hereinafter).

In the reverse direction sliding contact, the relative speed is higher than in the forward direction sliding contact, and therefore, formation of brush marks is more conspicuous than in the forward direction sliding contact, with the result that the reproducibility of fine lines is reduced and an image of a hard tone is often formed. Therefore, reduction of the reproducibility of Chinese characters in a word processor or the like cannot be avoided.

Accordingly, in recent commercial electrophotographic processes, the forward direction sliding contact is often adopted for the development. In case of the forward direction sliding contact, however, the relative speed for the sliding contact is inevitably low, and it is not easy to set such developing conditions that both of the image density and the reproducibility of fine lines can be simultaneously improved.

Summary of the Invention

We found that in the forward direction sliding contact development using a two-component type developer, if the angle $\theta$ (degrees) of the fixed main developing pole in the developing sleeve to the direction reverse to the moving direction of the drum and sleeve and the ratio of the diameter of the drum to the diameter of the sleeve are set within specific ranges, both of the reproducibility of lines and the image density can be improved most effectively in a well-balanced state.

Namely, it is a primary object of the present invention to provide a forward direction sliding contact developing process using a two-component type developer, in which both of the reproducibility of fine lines and the image density can be improved and an image having a high density and a high quality can be obtained.

More specifically, in accordance with the present invention, there is provided a developing process for forming an image having a high quality, which comprises supplying a two-component type developer comprising a magnetic carrier and a toner onto a developing sleeve having many magnetic poles arranged in the interior thereof and developing an electrostatic latent image by bringing a photosensitive material drum into sliding contact with a magnetic brush of the developer, wherein the moving direction of the developing sleeve is the same as the moving direction of the photosensitive material drum at the position of the sliding contact, the angle $\theta$ (degrees) of the fixed main developing pole in the developing sleeve to the direction reverse to the moving direction of the sleeve from the line connecting the centers of the drum and sleeve is 4° to 6°, and the ratio R of the diameter of the drum to the diameter of the sleeve is 2.2 to 2.5.

DETAILED DESCRIPTION OF THE PREFERRED EMBODIMENTS

Figure 1:
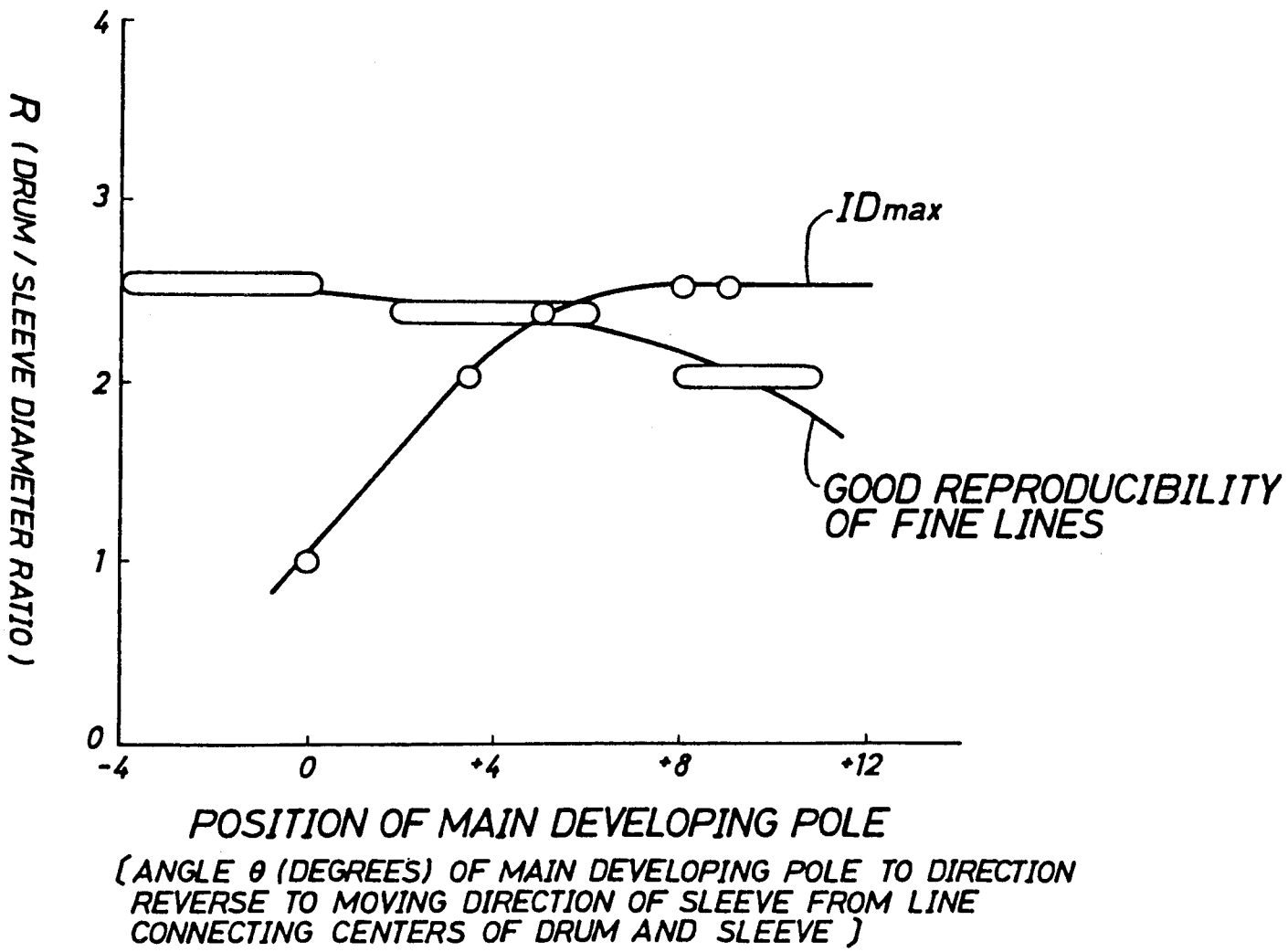
FIG. 1 is a graph illustrating the relation between the maximum image density of a solid portion of a copied image and the reproducibility of fine lines with respect to the relationship between the angle $\theta$ (degrees) of the main developing pole and the ratio R of the diameter of the drum to the diameter of the sleeve.

In the instant specification and appended claims, by the term "main developing pole" is meant the magnetic pole closest to the line connecting the center of the drum and the center of the sleeve, and the magnetic poles arranged in the developing sleeve, including the fixed main developing pole, are fixed and delivery of the developer is effected by the rotation of the sleeve. The position of the main developing pole is represented by the angle $\theta$ (degrees) between the line connecting the centers of the drum and sleeve and the direction reverse to the moving direction of the sleeve.

We made experiments by changing the position ($\theta$) of the main developing pole and the ratio (R) of the diameter of the drum to the diameter of the sleeve, and we experimentally determined the combination of the two factors giving a best reproducibility of fine lines and the combination of the two factors giving a highest image density. Thus, the results shown in the graph of FIG. 1 were obtained. From these results, it is understood that although the best reproducibility (Rf) of fine lines and the highest image density (IDmax) are changed according to $\theta$ and R, a drum/sleeve diameter ratio R giving a satisfactory reproducibility of letters and a satisfactory image density is present for a certain main pole position ($\theta$), and it also understood that satisfactory results of the reproducibility of fine lines and the image density are obtained when $\theta$ is 4° to 6°, and R is 2.5 to 2.2. Surprisingly, according to the present invention, only when $\theta$ and R are within the above-mentioned ranges, a highest image density and a best reproducibility of fine lines can be obtained in combination, and outside these ranges, it does not happen that both of the image density and the reproducibility of fine lines are satisfactory.

These facts were found as phenomena as the result of many experiments made by us. The theoretical clarification of these facts has not been sufficiently made, but it is considered that the causes of these facts will probably be as follows. In case of the forward direction sliding contact, shifting of the position ($\theta$) of the main pole toward the positive side means shifting of the sliding contact-initiating position to the upstream side. Supposing that the diameter of the drum is constant, increase of the drum/sleeve diameter ratio R means that the change of the drum-sleeve distance (D-S) between the sliding contact-initiating position (or the sliding contact-ending position) and the line connecting the centers of the drum and sleeve is small. In view of the foregoing, the following can be considered. Namely, from the viewpoint of the highest image density (IDmax), it is preferred that the sliding contact be effectively performed at the initial stage of the sliding contact by adopting a large value $\theta$ when R is large or by adopting a small value $\theta$ when R is small. In contrast, from the viewpoint of the reproducibility of fine lines, it is preferred that the sliding contact be effectively at the final stage of the sliding contact by increasing R when $\theta$ is a negative value or a small value or by decreasing R when $\theta$ is large. It is construed that within the ranges specified in the present invention, both of the functions are effectively exerted, and therefore, increase of the image density and increase of the reproducibility of fine lines can be simultaneously attained.

The conditions of the developing process of the present invention will now be described.

Figure 2:
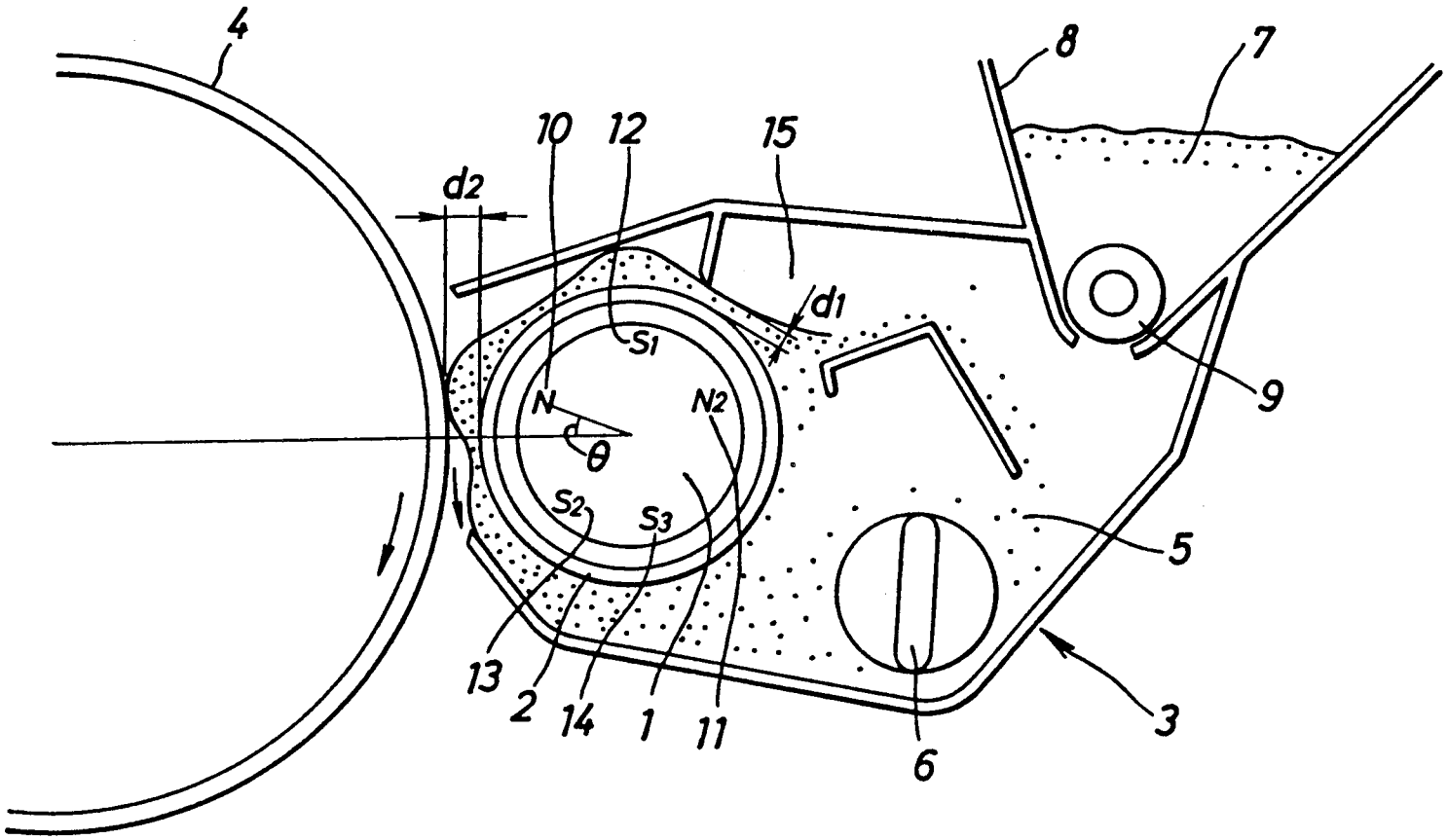
FIG. 2 is a diagram showing the outline of a developing apparatus in which the principle of the developing process of the present invention is adopted.

Referring to FIG. 2 illustrating the magnetic brush developing process of the present invention, a magnet roll 1 having magnetic poles is contained in a sleeve 2 formed of a non-magnetic material such as aluminum. This sleeve 2 is contained in a developing device 3. This developing device 3 is arranged in close proximity to a photosensitive material drum 4, and the sleeve 2 and the drum 4 confront each other through a drum-sleeve distance d2. A two-component type developer 5 is contained in the developing device 3 and is stirred by a stirring roller 6 to frictionally charge a magnetic carrier and a toner by contact with each other. A hopper 8 for containing the toner 7 therein and a toner feed roller 9 for feeding the toner 7 in the hopper to the developing device are attached to the developing device. When the toner concentration in the developing device is reduced below a certain level, the toner is supplied into the developing device 3.

The magnet roll 1 has a main developing pole 10 located in the vicinity of the line A connecting the centers of the sleeve and drum, and magnetic poles for pumping up the developer onto the sleeve, delivering the developer on the surface of the sleeve and discharging the developer from the sleeve. In the embodiment illustrated in FIG. 2, the magnetic pole 11 for pumping up the developer is disposed on the most upstream side of the sleeve. The first delivery magnetic pole 12 is arranged between this pumping magnetic pole 11 and the main developing pole 10, and the second delivery magnetic pole 13 is arranged downstream of the main developing pole 10 and the discharge magnetic pole 14 having the same polarity as the polarity of the delivery magnetic pole 13 is arranged downstream of the delivery magnetic pole 13. Thus, the magnet roll 1 has a five-pole structure. A brush-cutting gap 15 is arranged between the pumping magnetic pole 11 and the first delivery magnetic pole 12 to regulate the length of the magnetic brush to dl.

In the present invention, the moving direction of the sleeve 1 is the same as the moving direction of the drum 4 at the position of the sliding contact with the magnetic brush, the ratio R (=D/S) of the drum diameter D to the sleeve diameter S is adjusted within the above-mentioned range, and the position ($\theta$) of the main pole is adjusted within the above-mentioned range.

In setting the position ($\theta$) of the main pole, it is preferred that the angle between the pumping magnetic pole 11 and the first delivery magnetic pole 12 be 63° to 67° and the angle between the main pole 10 and the secondary delivery magnetic pole 13 be 63° to 67°.

It is preferred that the flux density of the main developing pole 10 be 500 to 1000 G, especially 800 to 900 G. It also is preferred that the cut brush length dl be 0.8 to 1.3 mm, especially 1.0 to 1.2 mm, and the D-S distance d2 be 0.8 to 1.5 mm, especially 1.0 to 1.2 mm.

All of known two-component type developers can be used as the two-component type developer in the present invention. As the magnet carrier, ferrite carriers, generally sintered ferrite particles and especially spherial sintered ferrite particles, are advantageously used. In general, it is preferred that the particle size of sintered ferrite particles be 20 to 200 microns.

If the particle size of sintered ferrite particles is smaller than 20 microns, it becomes difficult to form a good magnetic brush. If the particle size of sintered ferrite particles is larger than 200 microns, the above-mentioned brush marks, that is, scratch marks, are often formed in the obtained toner image.

Known sintered ferrite particles can be used in the present invention. For example, sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) are used. A soft ferrite containing at least one metal component selected from the group consisting of Cu, Zn, Mg, Mn and Ni, for example, Cu-Zn-Mg ferrite, is especially preferable for attaining the object of the present invention.

Any of coloring toners having electroscopic and fixing properties can be used as the toner in the present invention. A granular composition comprising a coloring pigment, a charge-controlling agent and the like dispersed in a binder resin and having a particle size of 5 to 30 microns is ordinarily used. A thermoplastic resin, an uncured thermosetting resin or a precondensate of a thermosetting resin is used as the binder resin. As suitable examples of the binder resin, there can be mentioned, in order of importance, a vinyl aromatic resin such as polystyrene, an acrylic resin, a polyvinyl acetal resin, a polyester resin, an epoxy resin, a phenolic resin, a petroleum resin and an olefin resin. For example, at least one member selected from the group consisting of carbon black, Cadmium Yellow, Molybdenum Orange, Pyrazolone Red, Fast Violet B and Phthalocyanine Blue is used as the pigment in the present invention. As the charge-controlling agent, there can be used an oil-soluble dye such as Nigrosine Base (CI 50415), Oil Black (CI 26150) or Spilon Black, a metal salt of naphthenic acid, a metal-containing complex salt dye or a metal soap of a fatty acid according to need.

It is preferred that the toner concentration in the developer be 2 to 10% by weight, especially 3 to 5% by weight.

A bias voltage is applied between the photosensitive material drum and the developing sleeve. This bias voltage is determined so that charges are sufficiently injected into the toner at the development but a trouble such as discharge breakdown is not caused in the photosensitive material or the magnetic brush. It is generally preferred that the bias voltage be 100 to 300 V, especially 150 to 250 V.

The polarity of the bias volute is selected so that when the charge polarity of the photosensitive material is positive, the polarity of the bias voltage is positive. Namely, the polarity of the bias voltage is the same as the charge polarity of the photosensitive material.

Known photosensitive materials for the electrophotography, for example, a selenium-vacuum deposited photosensitive material, an amorphous silicon photosensitive material, a CdS photosensitive material and an organic photoconductive photosensitive material can be used as the photosensitive material in the present invention. Formation of an electrostatic latent image can be easily accomplished according to a known method, for example, by a combination of charging and imagewise light exposure.

As is apparent from the foregoing description, according to the present invention, in the developing process of the sleeve rotation type using a two-component type magnetic developer, by adjusting the position (angle $\theta$) of the fixed main developing pole in the sleeve and the drum/sleeve diameter ratio (R) within certain specific ranges and carrying out the development of the forward direction sliding contact type, the reproducibility of fine lines and the image density can be simultaneously improved.

The present invention will now be described in detail with reference to the following examples that by no means limit the scope of the invention.

EXAMPLE 1

By using a drum/sleeve combination shown in Table 1 and changing the position (angle $\theta$) of the main pole, a toner image was formed. Other developing conditions were fixed as follows:

Brush-cutting gap: 1.0 mm

Drum-sleeve distance: 1.1 mm

Drum/sleeve peripheral speed ratio: $\frac{1}{3}$

Main pole intensity in sleeve: +800 G, 5-pole structure

Developer used: ferrite developer (toner concentration =4.5%) supplied by Mita Industrial Co.

Selenium photosensitive material: surface voltage =+750 V, bias voltage =+180 V

For evaluation of the image quality, the image density (ID) of the first copy was measured, and the resolution of the second copy (obtained by using the first copy as the original) was measured by a microdensitometer (Model PD5 supplied by Konica) and was expressed as the number of fine lines per mm in either the longitudinal direction or the lateral direction to evaluate the reproducibility of fine lines.

The obtained results are shown in Tables 2,3 and 4.

TABLE 1

| | Run I | Run II | Run III |
|---|---|---|---|
| Drum diameter (mm) | 78 | 78 | 120 |
| Sleeve diameter (mm) | 38 | 31 | 50 |
| R (drum/sleeve diameter ratio) | 2.05 | 2.52 | 2.40 |

TABLE 2

| | (Run I, R = 2.05) Position (angle $\theta$) of Main Pole | | | | |
|---|---|---|---|---|---|
| | −4° | 0° | 3.5° | 8° | 11° |
| ID of First Copy | 1.21 | 1.31 | 1.42 | 1.30 | 1.27 |
| Resolution of Second Copy | | | | | |
| longitudinal direction (lines/mm) | 2.5 | 2.5 | 2.8 | 3.2 | 3.2 |
| lateral direction (lines/mm) | 2.2 | 2.5 | 2.5 | 3.2 | 2.8 |

TABLE 3

| | (Run II, R = 2.52) Position (angle $\theta$) of Main Pole | | | | |
|---|---|---|---|---|---|
| | −4° | 0° | 4° | 8° | 12° |
| ID of First Copy | 1.16 | 1.23 | 1.31 | 1.43 | 1.40 |
| Resolution of Second Copy | | | | | |
| longitudinal direction (lines/mm) | 4.0 | 4.0 | 3.6 | 2.8 | 2.5 |
| lateral direction | 3.6 | 3.2 | 2.8 | 2.5 | 2.5 |

TABLE 3-continued

| | (Run II, R = 2.52) Position (angle θ) of Main Pole | | | | |
|---|---|---|---|---|---|
| | −4° | 0° | 4° | 8° | 12° |
| (lines/mm) | | | | | |

TABLE 4

| | (Run III, R = 2.40) Position (angle θ) of Main Pole | | | | | | |
|---|---|---|---|---|---|---|---|
| | −4° | 0° | 2° | 4° | 6° | 8° | 12° |
| ID of First Copy | 1.06 | 1.18 | 1.27 | 1.44 | 1.45 | 1.33 | 1.23 |
| Resolution of Second Copy | | | | | | | |
| longitudinal direction (lines/mm) | 2.8 | 3.2 | 3.6 | 3.6 | 3.6 | 2.8 | 2.5 |
| lateral direction (lines/mm) | 2.5 | 2.8 | 3.2 | 3.6 | 3.2 | 2.8 | 2.5 |

From the results shown in Table 2, it is seen that in case of R=2.05, high IDmax is obtained when the angle θ is about +3.5° and a good reproducibility is obtained when the angle θ is +8° to +11°.

From the results shown in Table 3, it is seen that in case of R=2.52, high IDmax is obtained when the angle θ is +8° to +12° and a good reproducibility of fine lines is obtained when the angle θ is −4° to 0°.

From the results shown in Table 4, it is seen that in case of R=2.40, high IDmax is obtained when the angle θ is +4° to +6° and a good reproducibility of fine lines is obtained when the angle θ is +2° to +6°.

The foregoing results are summarized in the curve of FIG. 1.

As is seen from FIG. 1, high image quality-giving developing conditions (conditions giving a high image density ID and a good reproducibility of fine lines) are such that R is in the range of $2.2 \leqq R \leqq 2.5$ while the position (angle θ) of the main pole is in the range of from $+4° \leqq \theta \leqq +6°$.

Comparative Example 1

A toner image was formed under the same developing conditions as described in Example 1 except that the drum diameter was set at 40 mm, the sleeve diameter was set at 38 mm and the ratio R was set at about 1.0, and the obtained image was evaluated. The obtained results are shown in Table 5.

TABLE 5

| | Position (angle θ) of Main Pole | | | | | |
|---|---|---|---|---|---|---|
| | −4° | 0° | 4° | 8° | 12° | 14° |
| ID of First Copy | 1.26 | 1.45 | 1.40 | 1.25 | 1.16 | 0.85 |
| Resolution of Second Copy | | | | | | |
| longitudinal direction (lines/mm) | 2.5 | 2.5 | 2.8 | 2.8 | 3.2 | 3.6 |
| lateral direction | 2.5 | 2.5 | 2.5 | 2.8 | 2.8 | 3.2 |

TABLE 5-continued

| | Position (angle θ) of Main Pole | | | | | |
|---|---|---|---|---|---|---|
| | −4° | 0° | 4° | 8° | 12° | 14° |
| (lines/mm) | | | | | | |

From the results shown in Table 5, it is seen that in case of R=1.0, high ID max is obtained when the angle θ is about 0° and a good reproducibility of fine lines is obtained when the angle θ is about +14°, and that there are no satisfactory conditions giving both of a high image density and a good reproducibility of fine lines.

Comparative Example 2

A toner image was formed under the same developing conditions as described in Example 1 except that the drum diameter was set at 120 mm, the sleeve diameter was set at 31 mm and the ratio R was set at 4, and the obtained copy was evaluated. The obtained results are shown in Table 6.

TABLE 6

| | Position (angle θ) of Main Pole | | | | |
|---|---|---|---|---|---|
| | −4° | 0° | 4° | 8° | 12° |
| ID of First Copy | 0.60 | 0.85 | 1.13 | 1.00 | 1.06 |
| Resolution of Second Copy | | | | | |
| longitudinal direction (lines/mm) | 2.8 | 2.5 | 2.5 | 2.2 | 2.2 |
| lateral direction (lines/mm) | 2.5 | 2.5 | 2.2 | 2.2 | 2.0 |

From the results shown in Table 6, it is seen that in case of R=4, any one of the image density ID and the reproducibility of line lines is not satisfactory within the above-mentioned range of the position (angle θ) of the main magnetic pole.

We claim:

1. A developing process for forming an image having a high quality, which comprises supplying a component type developer comprising a magnetic carrier and a toner onto a developing sleeve having many magnetic poles arranged in the interior thereof and developing an electrostatic latent image by bringing a photosensitive material drum into sliding contact with a magnetic brush of the developer, wherein the moving direction of the developing sleeve is the same as the moving direction of the photosensitive material drum at the position of the sliding contact, the angle θ (degrees) of the fixed main developing plea which is the magnetic pole, in the developing sleeve which is closest to the line connecting the center of the rum and the center of the sleeve in the direction reverse to the moving direction of the sleeve from said line connecting the centers of the drum and sleeve is 42° to 60°, and the ratio R of the diameter of the drum to the diameter of the sleeve is 2.2 to 2.5.

2. A developing process according to claim 1, wherein the flux density of the main developing pole is 500 to 1000 G.

3. A developing process according to claim 1, wherein the distance between the drum and sleeve (distance D-S) is 0.8 to 1.5 mm and the cut brush length is 0.8 to 1.3 mm.

* * * * *